United States Patent [19]

Matsumura et al.

[11] Patent Number: 4,833,282

[45] Date of Patent: May 23, 1989

[54] IGNITION DISTRIBUTOR FOR AN INTERNAL COMBUSTION ENGINE

[75] Inventors: Masami Matsumura; Toshi Sasaki; Yutaka Ohashi, all of Hyogo, Japan

[73] Assignee: Mitsubishi Denki Kabushiki Kaisha, Japan

[21] Appl. No.: 167,091

[22] Filed: Mar. 11, 1988

[30] Foreign Application Priority Data

Mar. 13, 1987 [JP] Japan ..... 62-37713[U]

[51] Int. Cl.[4] ..... H01H 1/00; H01H 19/00; F02P 7/02

[52] U.S. Cl. ..... 200/19 DR

[58] Field of Search ..... 200/19 R, 19 DR, 19 DC, 200/267, 268; 123/146.5 A, 633

[56] References Cited

U.S. PATENT DOCUMENTS

| | | | |
|---|---|---|---|
| 4,074,090 | 2/1978 | Hayashi et al. | 200/19 DR |
| 4,135,066 | 1/1979 | Yamanaka et al. | 200/19 R |
| 4,165,452 | 8/1979 | Olander et al. | 200/19 DR |
| 4,166,201 | 8/1979 | Olander et al. | 200/19 DR |
| 4,208,554 | 6/1980 | Sprague | 200/19 DR |
| 4,425,485 | 1/1984 | Sone et al. | 200/19 DR X |
| 4,631,369 | 12/1986 | Ohashi | 200/19 DR X |

*Primary Examiner*—J. R. Scott

*Attorney, Agent, or Firm*—Lowe, Price, Leblanc, Becker & Shur

[57] ABSTRACT

An ignition distributor for an internal combustion engine has a cylindrical distributor rotor of synthetic resin, rotated synchronously with the revolution of the engine, and a rotor electrode radially and outwardly extending from the central portion on the upper surface of the rotor. A plurality of circumferential electrodes are disposed in the rotating locus of the rotor and are separated from the rotor electrode by a discharge gap. The rotor electrode has the shape of letter T a vertical portion of which is fixed to the distributor rotor and a horizontal portion of which opposes to the circumferential electrode, being in the shape of a circular segment. The surface of the rotor electrode horizontal portion opposing to the respective circumferential electrodes is formed to have a rugged or wavy profile comprising a plurality of peaks and the rugged surface is coated with a dielectric material such as silicon varnish to provide a low discharge voltage and reduced radio frequency interference in prolonged use.

2 Claims, 2 Drawing Sheets

IGNITION DISTRIBUTOR FOR AN INTERNAL COMBUSTION ENGINE

FIELD OF THE INVENTION

This invention relates to a distributor for an internal combustion engine and, in particular, to a distributor for suppressing radio frequency interference or radio noise (hereinafter referred to as RFI) which is generated between a rotor electrode and respective circumferential electrodes.

BACKGROUND OF THE PRIOR ART

A conventional distributor for an internal combustion engine is shown in FIG. 1. A distributor housing 10 mounted in an internal combustion engine (not shown) consists of two portions, namely an upper distributor housing portion 11 and a lower shaft bearing portion 12. The lower portion 12 in a cylindrical shape has an axial bore 13 in which a rotary shaft 14 is inserted and supported at the upper end by a bearing member 15 and at the lower end by a metal sleeve 16. The rotary shaft 14 is at the upper end integrally connected with a bushing 17 upwardly extending axially of the enlarged space 18 in the upper portion 11 of the housing 10. The upper portion 11 is at its upper end engaged with and closed by a cap 19 secured to the housing 10 by screws 20. The bushing 17 has a rotary disc 21 secured between upper and lower parts 17*a*, 17*b* vertically divided and fixed by a screw 22. A rotary disc 21 extends radially and outwardly of the bushing 17. The bushing 17 at its top end is connected with a distributor rotor 23 which is secured by inserting the upper end of the bushing 17 into a bore provided in the distributor rotor 23 and fixed by a screw 24.

The distributor rotor 23 is made of synthetic resin and at its upper surface has a rotor electrode 25. The rotor electrode 25 is at its one end positioned about the rotating axis of the rotor 23 and is slidably connected with a contact 26 provided at the lower end of a central electrode 27, which is arranged in alignment with the rotary axis of the distributor rotor 23 and secured in a bore provided in the top wall of the cap 19. The electrode 25 at its other and outer end moves and passes near the side wall of the cap 19 and, successively, a plurality of circumferential electrodes 28 with a predetermined discharge gap therebetween. The circumferential electrodes 28 are positioned about the central electrode 27 circumferentially of the top wall of the cap 19 and spaced one to the other with a predetermined angular interval. A metal plate 39, best seen in FIG. 1, rotates with the rotor and generates air circulation in the rotor space 18.

The shaft 14 is rotated synchronously with the revolution of the internal combustion engine and rotates the disc 21 integrally therewith. The disc 21 has a radial slit (not shown) located at a position at which it faces to a photoelectric pickup. The photoelectric pickup consists of a light-emitting element 29 and a light-receiving element 30 which are arranged opposite to each other with respect to a symmetric plane containing the rotary disc 21. The unit 31 supported on a stepped and annular shoulder 11*a*, including the light-emitting and light-receiving elements 29, 30 also has a signal processing circuit 32 for processing output signal from the photoelectric pickup. In the above-mentioned apparatus, the shaft 14 rotates synchronously with the revolution of the engine (not shown). During rotation of the shaft 14 the slit in the rotary disc 21 causes infrared light beam intermittently passing it between the light-emitting element 29 and the light-receiving element 30. The output signal from the light-receiving element 30 is processed for the wave-form shaping and the like by signal processing circuit 32 thereby to obtain a predetermined crank angle signal or cylinder discriminating reference signal. Such a signal determines an ignition time when the ignition high voltage is supplied to the central electrode 27, where it is successively distributed to a plurality of circumferential electrodes 28 through the contact 26 and the rotor electrode 25 so that ignition is provided to the full charge in each cylinder of the internal combustion engine (not shown).

As shown in FIG. 2, the distributor rotor 23 of cylindrical shape at its upper surface has the rotor electrode 25 extending from the central portion laterally or radially. The rotor electrode 25 is generally in the shape of the letter T, a vertical portion 33 of which is fixed to the distributor rotor 23 and a horizontal portion 34 of which successively faces circumferential electrodes 28 when rotated. The surface 35 of the horizontal portion 34 opposing to the circumferential electrode 28 has a shape of circular section or segment and this segment portion is coated with dielectric material 135, such as silicon varnish, for suppressing RFI.

Such conventional apparatus as stated above, however, has gaps in the distributing line and as discharge from the rotor electrode 25 is initiated at a high voltage (for example 10–15 KV) to the circumferential electrode 28, high frequency (for example 500 MHz to 1 GHz) in this time produces the RFI causing difficulties to raise noise voltage in an electronic circuit such as the signal processing circuit which voltage causes operational errors. It has been known that in order to solve the problem a discharge starting voltage is suppressed by applying grease and the like to the end surface of the rotor electrode. However, even in such an improved apparatus the grease is carbonized by continuous discharge and, in a relative short time, the beneficial effect of grease for suppressing discharge starting voltage is considerably reduced and, accordingly, the RFI increases.

Various other proposals have been made for suppressing RFI by coating the surface of rotor electrode opposing the circumferential electrodes by a dielectric material such as silicon or the like. U.S. Pat. No. 4,074,090 discloses silicon coating disposed on the surface of the discharge electrode. U.S. Pat. No. 4,631,369 discloses wire net embedded in dielectric material such as silicon varnish coating layer coated on the discharge electrode surface.

However, in the presence of the silicon dielectric material fully coated on the discharging end of the rotor electrode, intermittent discharges arise due to charged particles accumulated in the dielectric material during the induced discharge, whereby a sufficient effect for suppressing the RFI is not attained. Furthermore, being exposed to the discharge, the silicon dielectric material is easily exfoliated and drops from the end of the rotor electrode so that it can not retain the RFI suppressing effect for long periods of time, resulting in poor durability and operability. On the other hand, since the dielectric material is coated onto the top end of the rotor electrodes one at a time, the dielectric material is not practical from the view of the mass-production thereof.

SUMMARY OF THE INVENTION

It is, accordingly, an object to the present invention to provide an ignition distributor in an internal combustion engine for suppressing RFI, having a high durability and a low manufacturing cost suitable for mass-production, by forming a discharge surface of the rotor electrode in a simple manner but the surface of dielectric material having high ability of suppressing the RFI not decreasing over time.

With this object in view, this invention improves a distributor for an internal combustion engine having a rotor electrode rotating together with the rotary axle of the engine, a plurality of circumferential electrodes disposed through a discharge gap in the rotating locus of the rotor electrode, and a contact provided at the lower end of a central electrode for supplying a high voltage to the rotor electrode. The horizontal portion of T shaped distributor rotor which faces the circumferential electrode and is coated with dielectric material such as silicon varnish has a face of circular segment which is formed in a wavy or rugged shape, i.e., one with a plurality of peaks.

DETAILED DESCRIPTION OF THE PREFERRED EMBODIMENT

Figure 1:
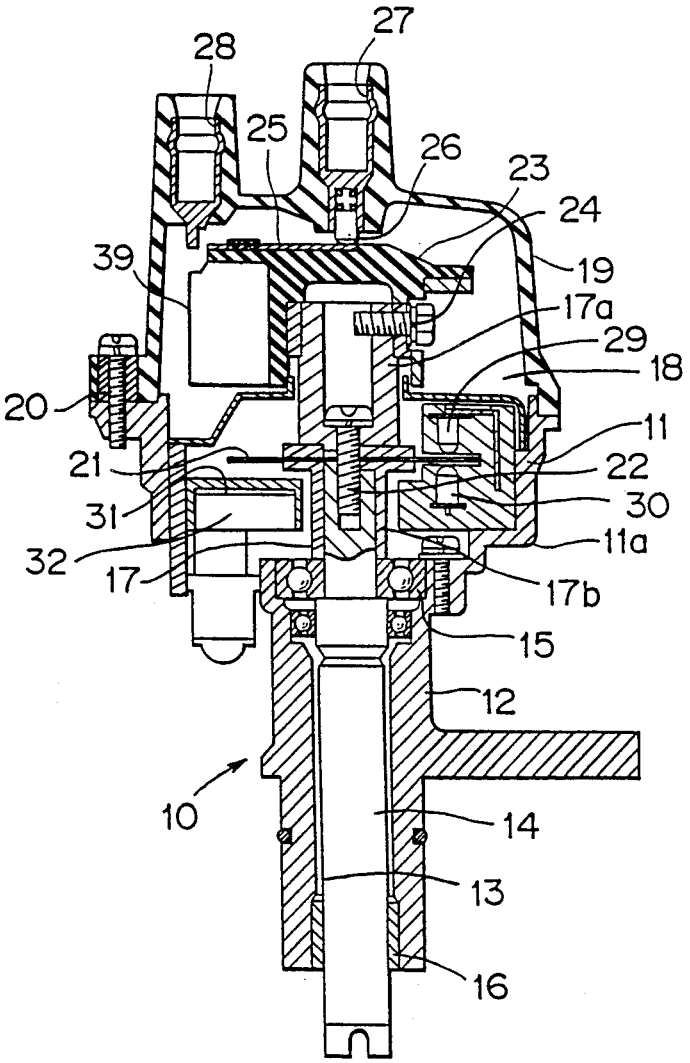
FIG. 1 PRIOR ART
FIG. 1 shows a sectional view of a conventional distributor for an internal combustion engine.
Figure 2:
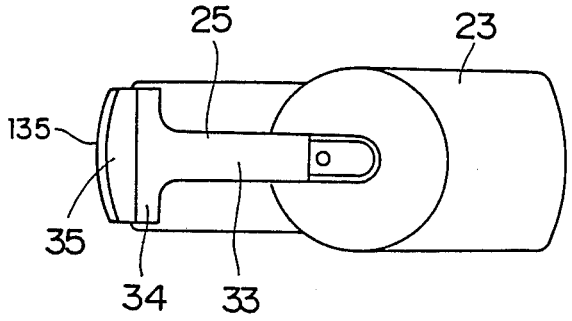
FIG. 2 PRIOR ART
FIG. 2 shows a plan view of a distributor rotor in the conventional distributor.
Figure 3:
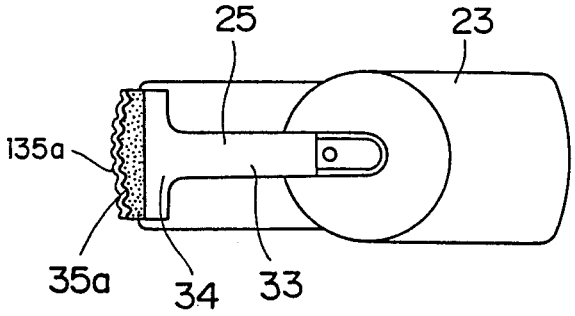
FIG. 3 shows a plan view of a distributor rotor according to the present invention.

A preferred embodiment of a distributor for an internal combustion engine according to the present invention will now be described with reference to FIG. 3. In the drawing, the distributor rotor 23 of cylindrical shape at its upper surface has the rotor electrode 25 extending from the central portion laterally or radially outwardly. The rotor electrode 25 has generally the shape of the letter T vertical portion 33 of which is fixed to the distributor rotor 23 and horizontal portion 34 of which successively faces circumferential electrodes (not shown in FIG. 3) when rotated. The surface 35*a* of the horizontal portion 34 adapted to be opposed to the distributor rotor 23 has a shape of circular section or segment and this segment portion is formed in a rugged or wavy shape that has a plurality of peaks shape and is coated with a dielectric material such as silicon varnish for suppressing RFI.

It is known that if a rotor electrode is provided with the operative end surface formed in a rugged state, electric charge is concentrated at peaks of the rugged or wavy surface so that discharge starting voltage in this state is lower than that in a flat surface. However, we have found that after long time of use the end face of the rotor electrode becomes more rugged or peaked more sharply due to continuous discharge, to generate a fine raggedness so that discharge starting voltage further drops. Accordingly if the surface is previously formed in a rugged or wavy shape the longer it is used, the more the discharge starting voltage stops. However, the rugged or wavy surface by itself at the beginning of its use does not provide a sufficient state of low discharge starting voltage. Therefore, a simple rugged surface has not practically been utilized for suppressing RFI.

On the other hand, according to the present invention, as the active end surface of the rotor electrode is formed in a rugged or wavy state and the same is coated with a coating 135*a* of a dielectric material such as silicon varnish, the rugged or wavy surface is maintained in a low discharge starting voltage not only at the beginning of its use, but also even after a long time of use. Thus, both at the beginning of its use and after long time of use, the discharge starting voltage at the rugged or wavy surface of the rotor electrode is maintained at a low value (5 KV for example) and RFI is at low frequencies (100 MHz for example). Therefore, there are no long term problems over prolonged use of the rotor in an ignition distributor.

What is claimed is:

1. In an ignition distributor for an internal combustion engine comprising a cylindrical distributor rotor of synthetic resin that is rotated synchronously with the revolution of the engine, a rotor electrode radially and outwardly extending from the central portion on an upper surface of the rotor, a plurality of circumferential electrodes disposed in the rotating locus of said rotor and separated from said rotor electrode by a discharge gap, and a contact electrode contacting said rotor electrode for supplying a high voltage to said rotor electrode, the rotor electrode having a shape generally like the letter T the vertical portion of which is disposed to pass adjacent to the circumferential electrodes, a surface of the rotor electrode opposing to the circumferential electrodes being formed overall in the shape of a circular segment with the horizontal portion coated with a dielectric material wherein:

the surface of the horizontal portion of the rotor electrode opposing to the respective circumferential electrodes is formed in a wavy shape comprising a plurality of peaks and is also coated with said dielectric material.

2. In an ignition distributor for an internal combustion engine comprising a cylindrical distributor rotor of synthetic resin that is rotated synchronously with the revolution of the engine, a rotor electrode radially and outwardly extending from the central portion on the upper surface of rotor, a plurality of circumferential electrodes disposed in the rotating locus of said rotor and separated from said rotor electrode by a discharge gap, and a contact electrode contacting said rotor electrode for supplying a high voltage to said rotor electrode, the rotor electrode having a shape generally like the letter T the vertical portion of which is fixed to the distributor rotor and the electrodes, a surface of the rotor electrode opposing to the circumferential electrode being formed overall in the shape of a circular segment with the horizontal portion coated with a dielectric material wherein:

the surface of the horizontal portion of the rotor electrode opposing to the respective circumferential electrodes is formed in a wavy shape comprising a plurality of peaks and is coated with a material comprising a silicon varnish.

* * * * *